US005094278A

United States Patent [19]

Arao et al.

[11] Patent Number: 5,094,278

[45] Date of Patent: Mar. 10, 1992

[54] FILLING NOZZLE

[75] Inventors: Takashi Arao; Yoshihiro Saijo; Tadaaki Kume, all of Tokushima, Japan

[73] Assignee: Shikoku Kakoki Co., Ltd., Tokushima, Japan

[21] Appl. No.: 656,533

[22] Filed: Feb. 19, 1991

[51] Int. Cl.[5] ..... B67C 3/22

[52] U.S. Cl. ..... 141/311 A; 141/31; 141/86; 141/116; 222/108; 239/590.3; 239/590.5

[58] Field of Search ..... 141/31, 115, 116, 119, 141/120, 121, 126, 311 A, 286, 86; 239/590.3, 590.5, 553.3, 533.1, 120; 222/108, 109, 571, 189

[56] References Cited

U.S. PATENT DOCUMENTS

| | | | |
|---|---|---|---|
| 3,633,824 | 1/1972 | Aghnides | 239/590.3 X |
| 3,792,724 | 2/1974 | Hunter | 141/115 |
| 4,119,276 | 10/1978 | Nelson | 239/590.3 |
| 4,711,277 | 12/1987 | Clish | 141/311 A |
| 4,730,786 | 3/1988 | Nelson | 239/590.3 |
| 4,958,669 | 9/1990 | Ohta | 141/311 A |

*Primary Examiner*—Ernest G. Cusick

*Attorney, Agent, or Firm*—Armstrong, Nikaido, Marmelstein, Kubovcik & Murray

[57] ABSTRACT

A filling nozzle comprising a vertical tubular nozzle body, and at least one perforated plate disposed at a lower-end opening of the nozzle body for preventing a liquid from flowing down under gravity by the surface tension of the liquid. The perforated plate has an opening degree varying from small to great from its center or the vicinity thereof toward its periphery or the vicinity thereof.

12 Claims, 9 Drawing Sheets

FILLING NOZZLE

BACKGROUND OF THE INVENTION

The present invention relates to filling nozzles for apparatus for filling a fluid food or like liquid into containers in a specified amount in each container.

FIG. 15 shows a known filling nozzle which comprises a vertical tubular nozzle body 61, and at least one perforated plate (not shown) disposed at a lower-end opening of the nozzle body 61 for preventing a liquid from flowing down under gravity by the surface tension of the liquid. The perforated plate is uniform in opening degree from its center toward the periphery thereof.

With the filling nozzle, the velocity of the liquid discharged from the lower-end opening of the nozzle body is higher toward the center of the opening and lower toward the periphery thereof. Since the perforated plate is uniform in opening degree from the center toward the periphery, the liquid to be discharged from the nozzle passes through the perforated plate with the force imparted to the liquid over the entire area of the opening, with the result that the liquid portion of higher velocity close to the center of the opening vigorously impinges on the bottom of a container C, whereupon the impinging liquid portion splashes about or incorporates air thereinto to bubble up. Such phenomena are undesirable for carrying out the filling operation smoothly.

SUMMARY OF THE INVENTION

The main object of the present invention is to overcome the above problem and to provide a filling nozzle for carrying out a smooth filling operation.

The above object is fulfilled by a filling nozzle comprising a vertical tubular nozzle body, and at least one perforated plate disposed at a lower-end opening of the nozzle body for preventing a liquid from flowing down under gravity by the surface tension of the liquid, the perforated plate having an opening degree varying from small to great from the center of the plate or from the vicinity of the center toward the periphery of the plate or toward the vicinity of the periphery.

Thus with the filling nozzle described above, the opening degree of the perforated plate varies from small to great from the center of the plate or the vicinity thereof toward the center of the plate or the vicinity thereof, so that the resistance to the fluid passing through the central portion of the perforated plate is greater than the resistance to the fluid passing through the peripheral portion of the perforated plate. Consequently, the velocity of the liquid to be discharged from the portion of the nozzle body opening close to its center is attenuated relatively to the velocity of the liquid to be discharged from the portion close to its periphery. This prevents the liquid discharged from the nozzle body from vigorously impinging on the bottom of the container.

DESCRIPTION OF THE PREFERRED EMBODIMENTS

Next, embodiments of the present invention will be described in detail with reference to FIGS. 1 to 14.

Figure 3:
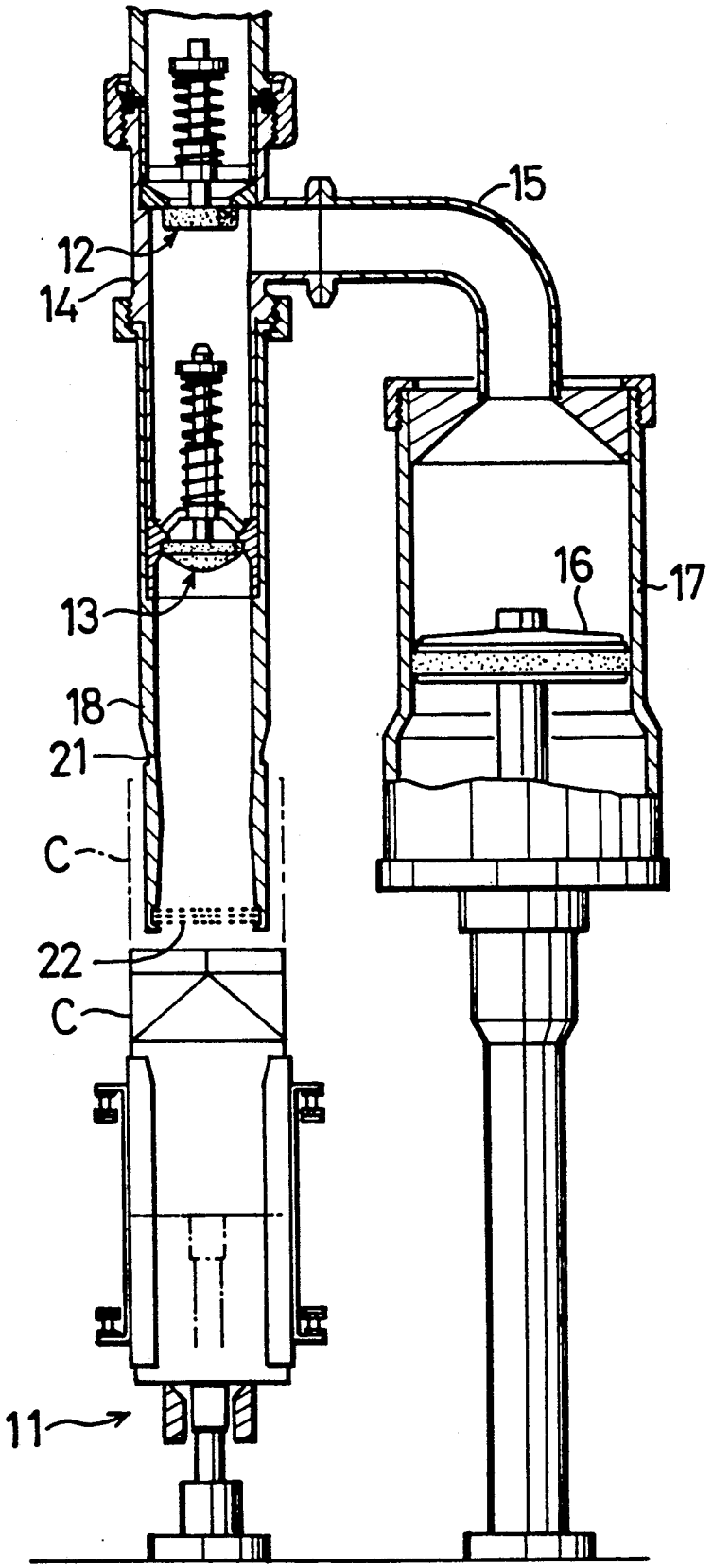
FIG. 3 is a view in vertical longitudinal section of a filling apparatus including the nozzle.

A liquid filling apparatus will be described briefly in its entirety with reference to FIG. 3. The apparatus comprises a vertical filling cylinder 14 disposed above a path of transport of containers C by a conveyor 11 and having upper and lower check valves 12, 13, a metering cylinder 17 connected by a pipe 15 to an intermediate portion of the filling cylinder 14 between the check valves 12, 13 and housing a piston 16, and a filling nozzle 18 connected to the lower end of the cylinder 14. The upper end of the filling cylinder 14 is connected to an unillustrated liquid tank.

Except for the filling nozzle 18, the filling apparatus is already known and will not be described.

Figure 1:
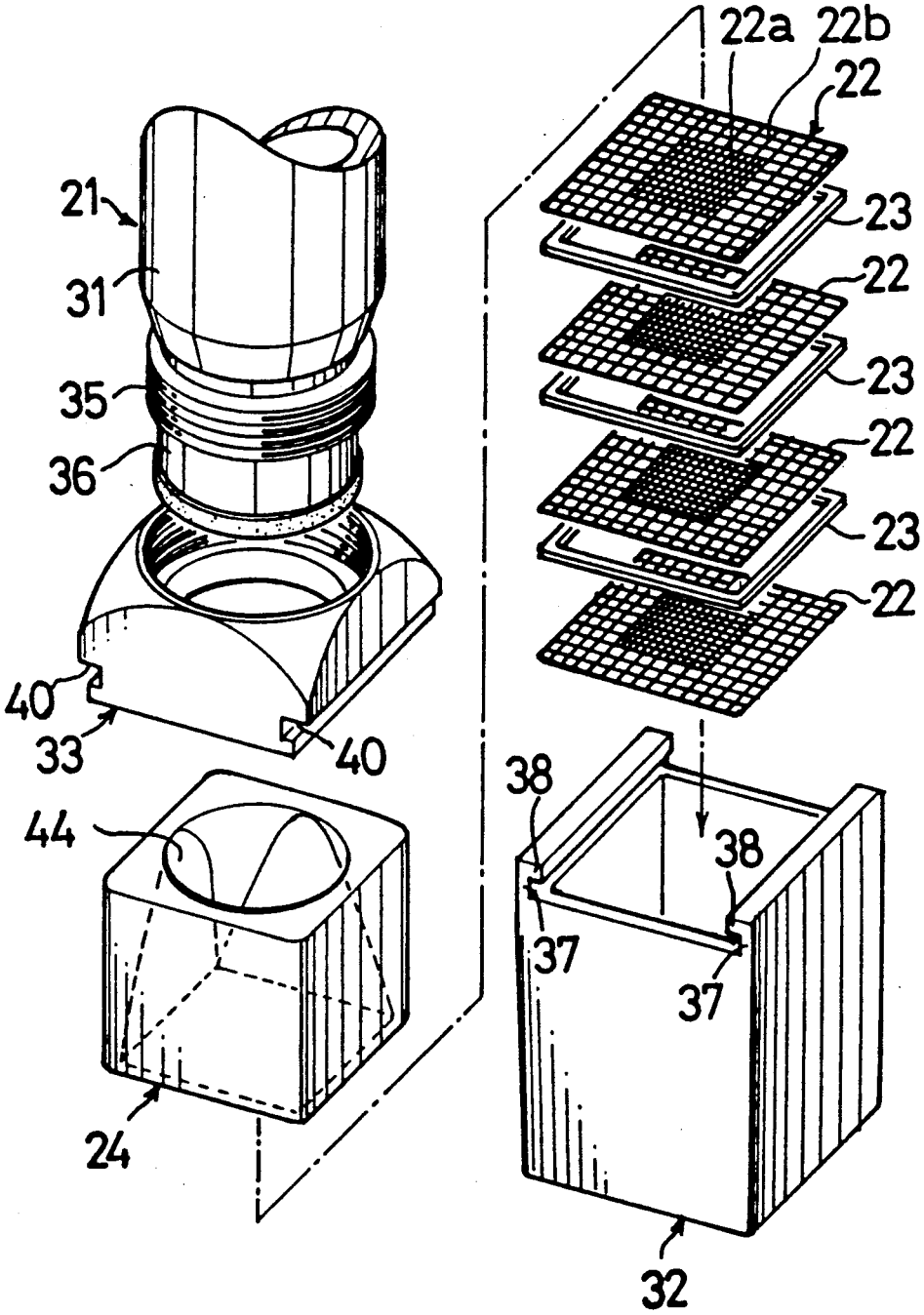
FIG. 1 is an exploded perspective view of a filling nozzle.
Figure 2:
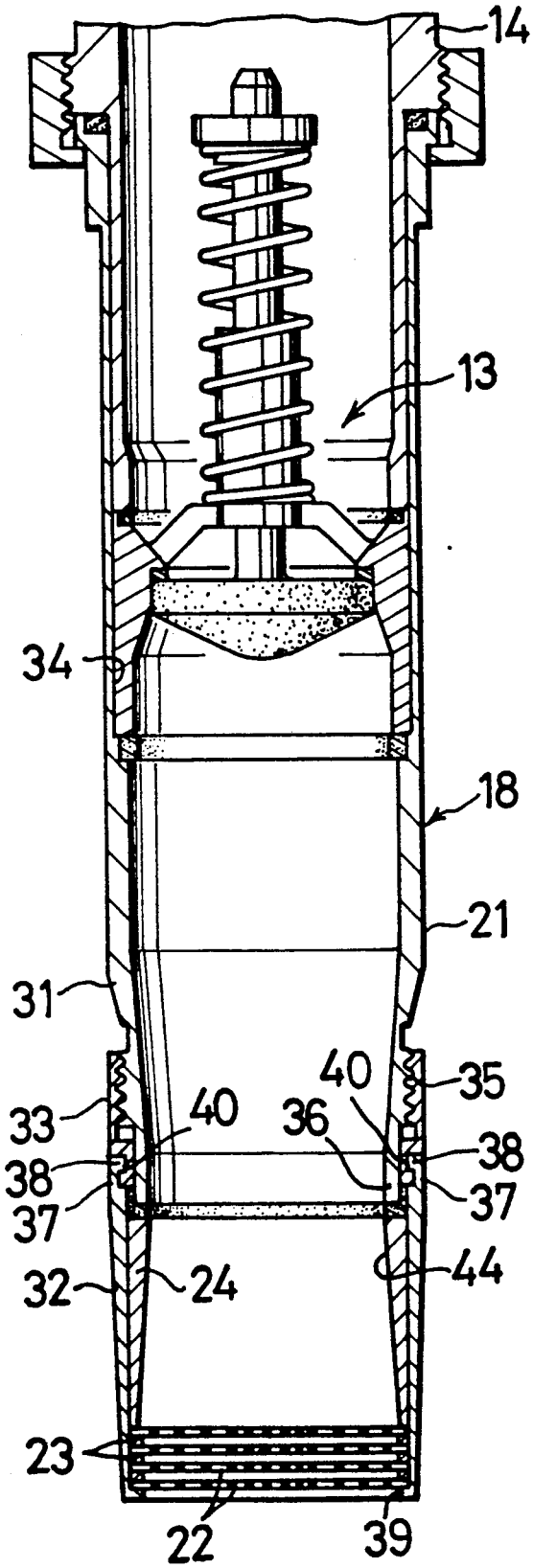
FIG. 2 is a view in vertical longitudinal section of the filling nozzle.

With reference to FIGS. 1 and 2, the filling nozzle 18 comprises a vertical tubular nozzle body 21, four perforated plates 22 arranged one above another in an opening of the nozzle body 21 at its lower end for preventing a liquid from flowing down under gravity by the surface tension of the liquid, spacers 23 three in number and interposed between the four perforated plates 22, and a holding member 24 provided on the uppermost perforated plate 22.

The nozzle body 21 comprises an upper tube 31 circular in cross section, a lower tube 32 square in cross section, and a square nut 33 removably joining these tubes 31 and 32 together. The upper portion of the inner periphery of the upper tube 31 is a large-diameter portion 34 having inserted therein the lower check valve 13 and the lower portion of the filling cylinder 14. The upper tube 31 is formed close to its lower end with an externally threaded portion 35 having the nut 33 screwed thereon. The portion of the upper tube 31 lower than the threaded portion 35 is a spigot portion 36 in the form of a straight short tube. The upper end of the inner periphery of the lower tube 32 is in contact with the outer surface of the lower end of the spigot portion 36. The upper end of the lower tube 32 is provided with a pair of opposed upward extensions 37, and ridges 38 opposed to each other are formed on the opposed faces of the respective extensions 37. An inward flange 39 is formed at the lower end of the lower tube 32 on its inner periphery. Grooves 40 having the ridges 38 fitted therein are formed in two parallel side surfaces of the nut 33 at its lower end.

The four perforated plates 22 have the same shape, accommodated in the lower tube 32 and each have a square peripheral edge in conformity with the inner periphery of the lower tube 32. The lowermost perforated plate 22 is supported at its peripheral edge by the flange 39.

The perforated plates 22 are made of stainless steel. The perforations are formed by etching. The perforations are defined by intersecting latticelike linear portions, and the corresponding linear portions are directly connected to each other at each intersection point without overlapping. The opening degree of the perforated plate 22 is defined as the ratio per unit area of the total volume of the perforations only of the perforated plate 22 to the entire volume of the plate 22 including the perforations, as expressed in percentage. The opening degree is varied from small to great in two steps from the center of the plate 22 toward the periphery thereof. Thus, the portion 22*a* including the center of the plate 22 and the vicinity thereof is smaller than the portion 22*b* including the periphery of the plate 22 and the vicinity thereof in opening degree. The former portion 22*a* of smaller opening degree is square in shape.

Figure 4:
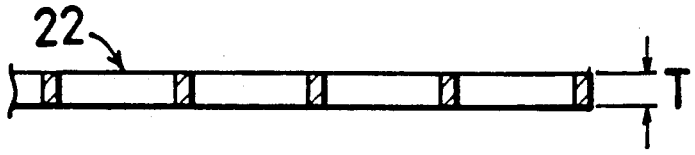
FIG. 4 is a side elevation of a perforated plate.
Figure 5A:
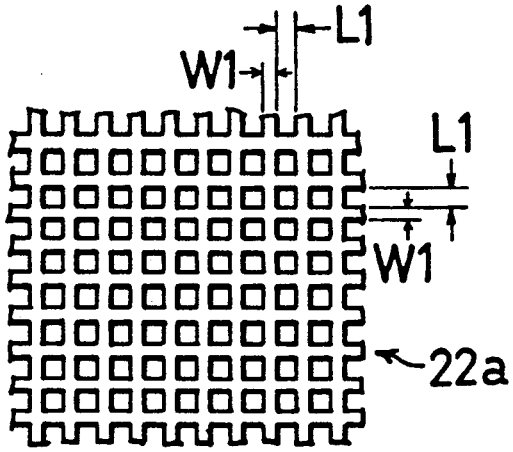
FIGS. 5 (*a*) and 5 (*b*) are fragmentary plan views showing the perforated plate on an enlarged scale.
Figure 5B:
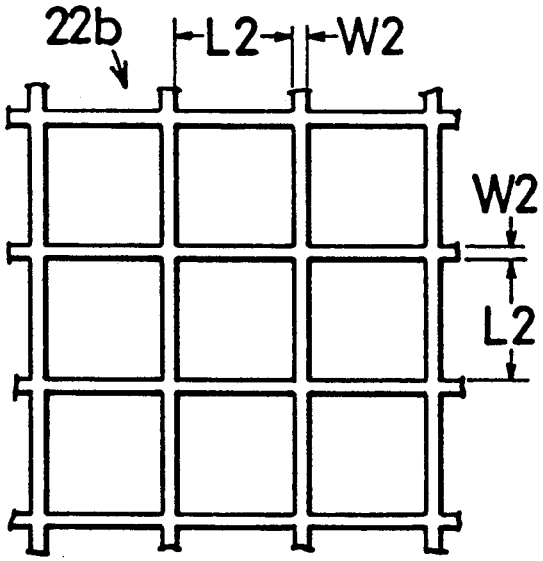

The dimensions of the perforated plate will be described numerically with reference to FIG. 4 and FIGS. 5 (*a*) and 5 (*b*). The perforated plate 22 is 0.3 to 1.0 mm in thickness. If thinner, the plate is insufficient in strength, but if thicker, the plate is difficult to form by etching. FIG. 5 (*a*) shows the portion 22*a* including the center of the plate and the vicinity thereof and having the smaller opening degree. FIG. 5 (*b*) shows the portion 22*b* of great opening degree including the periphery of the plate and the vicinity thereof. With reference to FIG. 5 (*a*), suppose each side of the perforation is 0.379 mm in length L1, and the width W1 of the linear portion is 0.25 mm. The opening degree of the illustrated portion is then 35.6%. With reference to FIG. 5 (*b*), suppose each side of the perforation is 3.942 mm in length L2, and the width W2 of the linear portion is 0.25 mm. The opening degree of the portion 22*b* is then 86.7%. For the convenience of etching, the perforations are to be so dimensioned that the minimum length of each side thereof is the thickness of the plate multiplied by 0.8 and that the minimum width of the linear portion is about 0.1 mm.

Figure 6A:
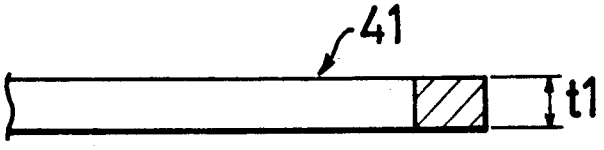
FIGS. 6.(*a*), 6 (*b*) and 6 (*c*) are side elevations showing spacers.
Figure 6B:
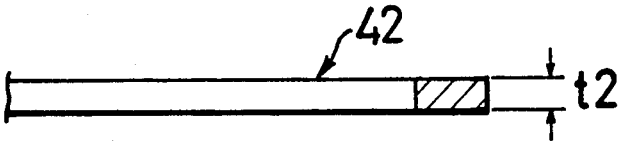
Figure 6C:
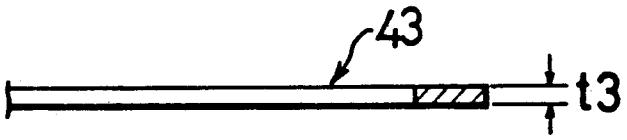

FIGS. 6 (*a*) to 6 (*c*) show different kinds of spacers 41 to 43 varying in thickness. With reference to these drawings, t1 is 1.5 mm, t2 is 1.0 mm and t3 is 0.5 mm. The spacers 41 to 43 of different thicknesses are used selectively depending on the kind of liquid to be handled. For liquids of relatively high viscosity, for example, relatively thick spacers 41 are used to hold the perforated plates spaced apart by a large distance, whereas for liquids of low viscosity, relatively thin spacers 43 are used to hold the perforated plates at a small spacing.

The holding member 24 is fitted in the lower tube 32 in substantially intimate contact therewith and has a liquid channel 44 with a cross section which is altered from a circular form to a square form from its upper end to the lower end thereof.

How to assemble the filling nozzle will be described briefly. First, the four perforated plates 22 and the three spacers 23 are alternately placed into the lower tube 32, and the holding member 24 is then placed in over the uppermost plate 22. Subsequently, the lower tube 32 and the nut 33 are slidingly moved relative to each other to fit the ridges 38 of the lower tube 32 into the grooves 40 of the nut 33. The nut 33 is thereafter screwed on the externally threaded portion 35 of the upper tube 31. The spigot portion 36 of the upper tube 31, when inserted into the lower tube 32, finally prevents the sliding movement of the nut 33 and the lower tube 32 relative to each other, whereby the assembly is completed. Of course, the filling nozzle is disassembled by a procedure reverse to the above.

Figure 7:
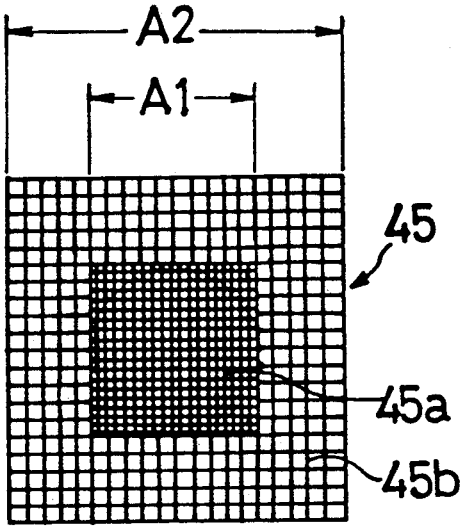
FIGS. 7 to 10 are plan views showing modified perforated plates.
Figure 9:
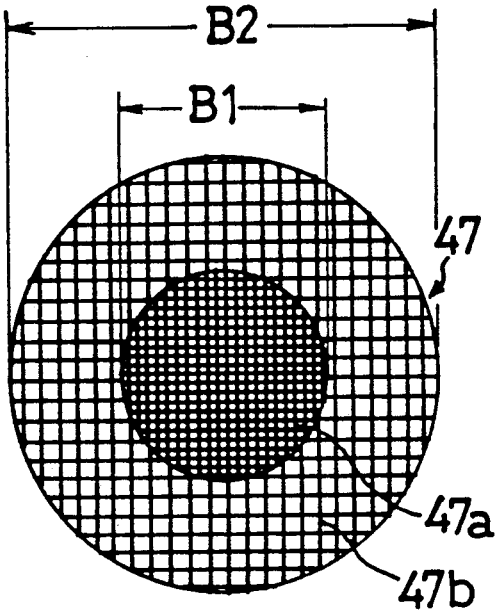
Figure 8:
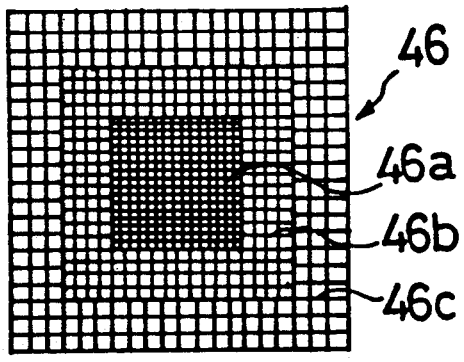
Figure 10:
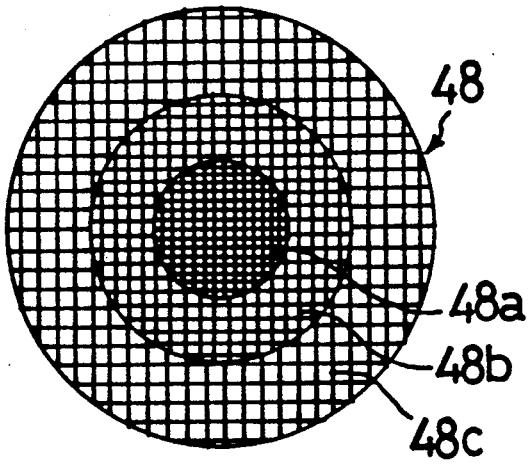

FIGS. 7 to 10 show various modifications of perforated plate. FIG. 7 shows a perforated plate 45 which is altered in two steps in opening degree like the perforated plate 22. More specifically, the perforated plate 45 comprises a portion 45*a* having a small opening degree and a portion 45*b* having a great opening degree. With this perforated plate 45, the portion 45*a* of small opening degree is square, and the length A1 of each side thereof is approximately one-half of the length A2 of each side of the entire plate 45. FIG. 3 shows a perforated plate 46 comprising three portions 46*a*, 46*b* and 46*c* which are altered from small to great in opening degree in three steps. Although not shown, the opening degree may of course be altered in at least four steps. FIGS. 9 and 10 respectively show circular perforated plates 47, 48 for use in nozzles (not shown) having a circular opening at the lower end thereof. These perforated plates 47, 48 correspond to the perforated plates 45, 46 shown in FIGS. 7 and 8, respectively, with respect to the opening degree. The perforated plate 47 shown in FIG. 9 comprises two portions 47*a*, 47*b*. The portion 47*a* of small opening degree is circular and has a diameter B1 which is approximately one-half of the diameter B2 of the entire perforated plate 47. The perforated plate 48 shown in FIG. 10 comprises three portions 48*a*, 48*b* and 48*c*.

Figure 11:
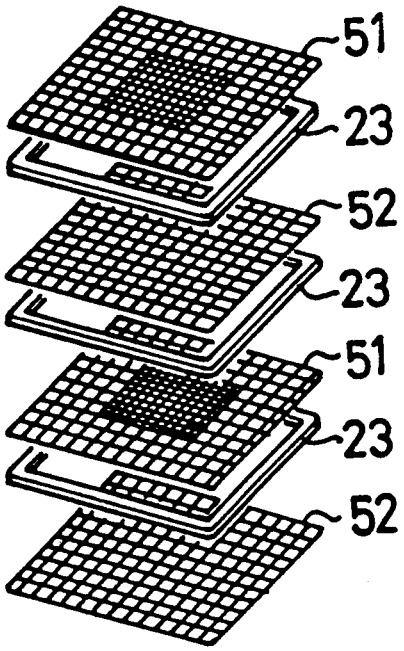
FIGS. 11 to 13 are perspective views showing different combinations of perforated plates.
Figure 12:
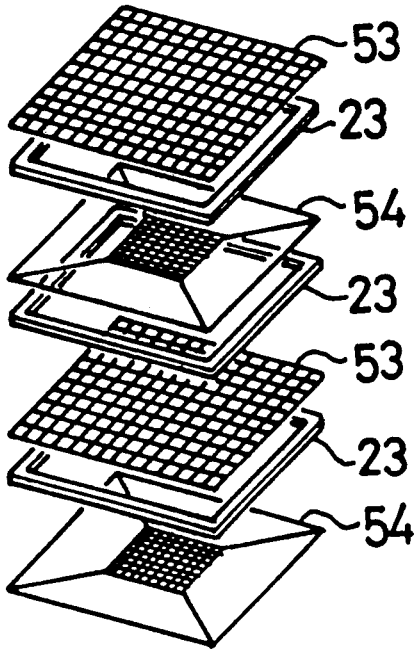
Figure 13:
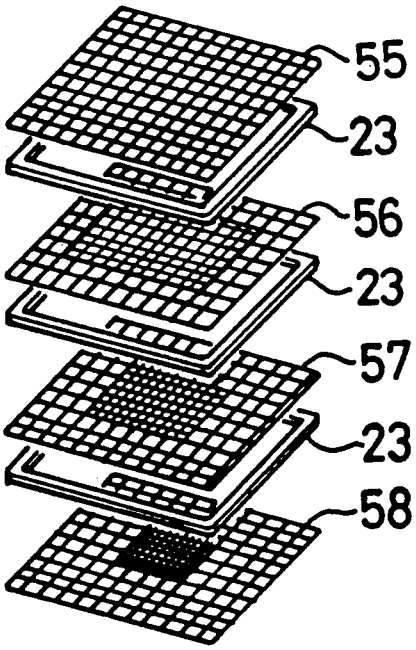

Although the four perforated plates used in the foregoing embodiment are identical, different combinations of perforated plates will be described with reference to FIGS. 11 to 13. FIG. 11 shows two kinds of perforated plates 51, 52, each two in number. The first and third perforated plates 51 from above are altered in opening degree in two steps, while the second and fourth perforated plates 52 from above have a definite opening degree over the entire area. FIG. 12 shows two kinds of perforated plates 53, 54, each two in number. Although the opening degree of the first and third plates 53 from above is uniform over the entire area, the opening degree of the second and fourth plates 54 from above is varied in two steps. The opening degree of these perforated plates 54 is about 100% at the periphery and in the vicinity thereof. FIG. 13 shows four kinds of perforated plates 55 to 58, each one in number. The uppermost plate 55 has a uniform opening degree over the entire area. While the opening degree of the second to fourth perforated plates 56 to 58 from above is altered in two steps, the portion of each of these plates 56 to 58 including the center and the vicinity thereof and having the smaller opening degree is decreased from plate to plate downward in area and also in opening degree.

Figure 14:
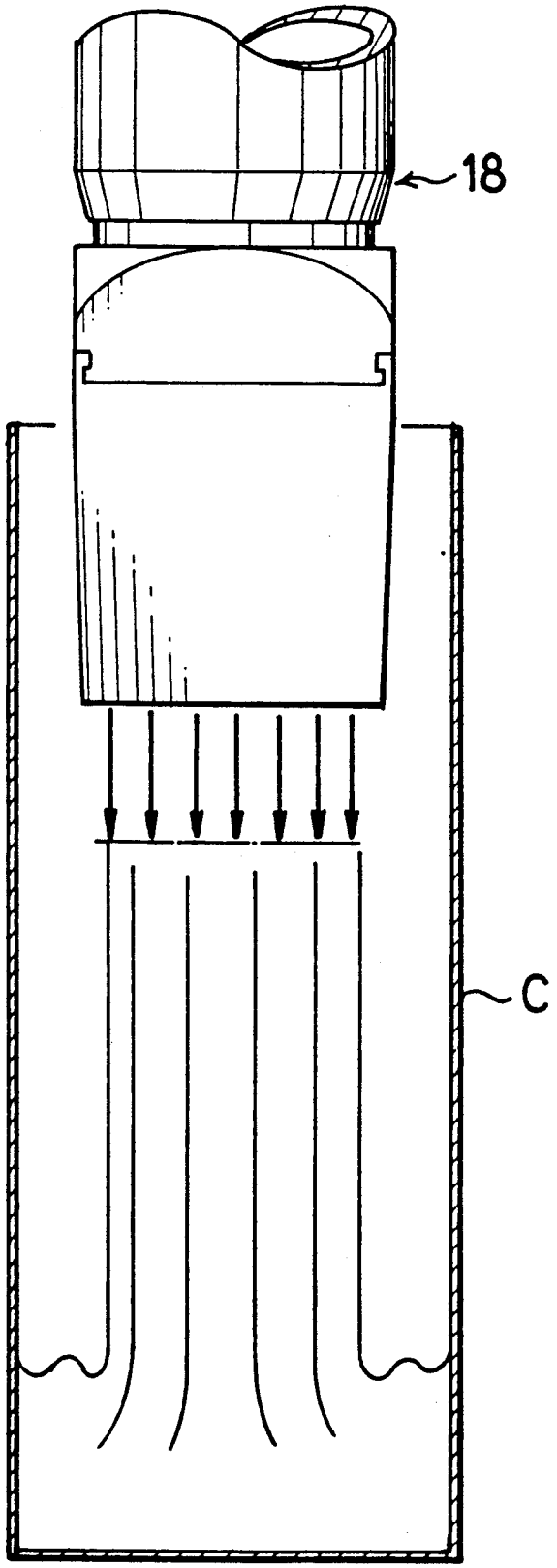
FIG. 14 is a diagram illustrating how a liquid is filled with use of the filling nozzle of the present invention.
Figure 15:
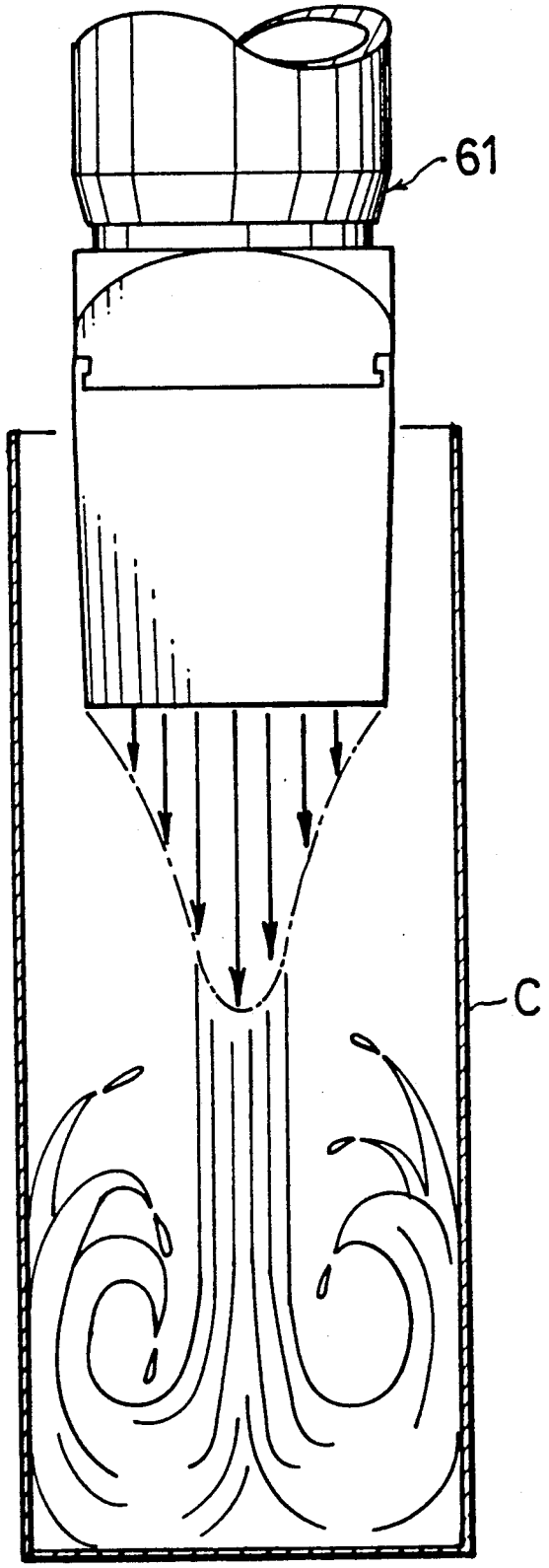
FIG.15 PRIOR ART
FIG. 15 is a diagram illustrating how a liquid is filled with use of a conventional nozzle.

FIG. 14 shows how a liquid is filled into the container C using the filling nozzle 18 of the present invention. The velocity of the liquid discharged from the nozzle 18 is uniform from the center of the lower-end opening of the nozzle 18 to its periphery, i.e., over the entire area of the opening, unlike the velocity of the liquid through the conventional nozzle which is higher toward the center of the opening as described first (see FIG. 15). Accordingly, the liquid will not impinge on the bottom of the container C vigorously. This is attributable to the following reason. Since the opening degree of the perforated plate is smaller at the portion including its center and the vicinity thereof than at the portion including its periphery and the vicinity thereof, the resistance to the fluid passing through the former portion is greater than the resistance to the fluid passing through the latter portion. The velocity of the liquid discharged from the nozzle opening portion close to the center is therefore attenuated relative to the velocity of the liquid discharged from the opening portion close to its periphery.

Although the foregoing embodiments include four perforated plates, the number of perforated plates is not limitative; one to about six perforated plates are usable.

The shape of the perforations of perforated plates, which is square as illustrated, may alternatively be circular, triangular, pentagonal or otherwise.

The linear portions defining the perforations of the perforated plate, each intersecting others at right angles, may alternately intersect at other angles. In this case, the perforations are rhombic.

What is claimed is:

1. A filling nozzle for use in an apparatus for filling a specified amount of liquid, the filling nozzle comprising:

a vertical tubular nozzle body, and one perforated plate disposed at a lower-end opening of the nozzle body for preventing the liquid from flowing down under gravity by the surface tension of the liquid, the perforated plate having an opening degree varying from small to great from the center of the plate or from the vicinity of the center toward the periphery of the plate or toward the vicinity of the periphery.

2. A filling nozzle as defined in claim 1 wherein the ratio per unit area of the total volume of the perforations only of said perforated plate to the entire volume of said plate including said perforations at said center of said perforated plate and the vicinity of said center is approximately at least 30%.

3. A filling nozzle for use in an apparatus for filling a specified amount of liquid, the filling nozzle comprising:

a vertical tubular nozzle body, and a plurality of perforated plates arranged adjacent to one another in a lower-end opening of the nozzle body for preventing the liquid from flowing down under gravity by the surface tension of the liquid, at least one of the perforated plates having an opening degree varying from small to great from the center of the plate or from the vicinity of the center toward the periphery of the plate or toward the vicinity of the periphery.

4. A filling nozzle as defined in claim 3 wherein the ratio per unit area of the total volume of the perforations only of said at least one perforated plate to the entire volume of said plate including said perforations at said center of said at least one perforated plate and the vicinity of said center is approximately at least 30%.

5. A filling nozzle as defined in any one of claims 1 to 4 wherein the perforations of the perforated plate are defined by intersecting linear portions, and the corresponding linear portions are directly connected to each other at each intersection point without overlapping.

6. A filling nozzle as defined in any one of claims 1 to 4 wherein the perforated plate is made of stainless steel.

7. A filling nozzle as defined in any one of claims 1 to 4 wherein the perforations of the perforated plate are formed by etching.

8. A filling nozzle as defined in any one of claims 1 to 4 wherein the perforated plate is 0.3 to 1.0 mm in thickness.

9. A filling nozzle as defined in any one of claims 1 to 4 wherein the perforations of the perforated plate are defined by a plurality of linear portions having a width of at least 0.1 mm.

10. A filling nozzle as defined in claim 3 wherein the nozzle body has an upper tube and a lower tube removably connected to each other, and the lower end of the lower tube is formed on its inner periphery with an inward flange supporting the peripheral edge of the lowermost perforated plate, a spacer being interposed between each two adjacent perforated plates.

11. A filling nozzle as defined in claim 10 further comprising different kinds of spacers having varying thicknesses.

12. A filling nozzle as defined in claim 11 wherein the different kinds of spacers are 0.5 to 1.5 mm in thickness.

* * * * *